US006874647B2

(12) United States Patent
Bloom et al.

(10) Patent No.: US 6,874,647 B2
(45) Date of Patent: Apr. 5, 2005

(54) PLASTIC CLOSURE, CLOSURE AND CONTAINER PACKAGE, AND METHOD OF MANUFACTURE

(75) Inventors: Kenneth S. Bloom, Bloomdale, OH (US); Stephen A. Eilertson, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 45 days.

(21) Appl. No.: 10/217,691

(22) Filed: Aug. 12, 2002

(65) Prior Publication Data

US 2004/0108294 A1 Jun. 10, 2004

(51) Int. Cl.[7] ..... B65D 45/34
(52) U.S. Cl. ..... 215/276; 215/350
(58) Field of Search ..... 215/276, 274, 215/349–352, 250–252, 329, 347, 341, 343–345; 220/188, 319; 251/347, 364, 343–345

(56) References Cited

U.S. PATENT DOCUMENTS

| | | | | | |
|---|---|---|---|---|---|
| 2,456,607 | A | * | 12/1948 | Shaffer | 215/350 |
| 2,619,246 | A | | 11/1952 | Staller | |
| 3,434,615 | A | * | 3/1969 | Barletta | 215/276 |
| 3,709,395 | A | | 1/1973 | Brennan | |
| 3,760,969 | A | * | 9/1973 | Shimamoto et al. | 215/247 |
| 3,924,772 | A | * | 12/1975 | Magnani | 215/276 |
| 4,128,184 | A | | 12/1978 | Northup | |
| 4,554,125 | A | * | 11/1985 | Knapp | 264/266 |
| 4,723,678 | A | * | 2/1988 | Kollen et al. | 215/347 |
| 4,747,500 | A | | 5/1988 | Gach | |
| 4,813,561 | A | | 3/1989 | Ochs | |
| 4,880,127 | A | * | 11/1989 | Doi | 215/252 |
| 5,031,787 | A | * | 7/1991 | Ochs | 215/276 |
| 5,314,084 | A | * | 5/1994 | Folta et al. | 215/249 |
| 5,346,082 | A | | 9/1994 | Ochs | |
| 5,579,936 | A | * | 12/1996 | Costa et al. | 215/261 |
| 5,819,968 | A | | 10/1998 | Jones | |
| 5,868,264 | A | * | 2/1999 | Fulford et al. | 215/232 |
| 5,950,638 | A | | 9/1999 | Crosta | |
| 5,984,124 | A | * | 11/1999 | Takano | 215/252 |
| 6,142,325 | A | * | 11/2000 | Chomik | 215/343 |
| 6,276,543 | B1 | | 8/2001 | German | |
| 6,286,699 | B1 | * | 9/2001 | Sudo | 215/364 |
| 6,371,318 | B1 | | 4/2002 | Riffer | |
| 6,399,170 | B1 | | 6/2002 | Hock et al. | |
| 6,662,958 | B2 | * | 12/2003 | German et al. | 215/252 |
| 2003/0098286 | A1 | * | 5/2003 | Bloom et al. | |

FOREIGN PATENT DOCUMENTS

| | | |
|---|---|---|
| FR | 1152487 | 2/1958 |
| GB | 872981 | 7/1961 |
| GB | 884173 | 12/1961 |
| JP | 10152156 | 6/1998 |

OTHER PUBLICATIONS

U.S. Appl. No. 09/994,554 filed Nov. 27, 2001.

* cited by examiner

*Primary Examiner*—Lien Ngo

(57) ABSTRACT

A plastic closure includes a plastic closure shell having a base wall with a central opening and a skirt with at least one internal thread or bead for securing the closure to a container finish. A plastic disk is retained within the shell parallel to but spaced from the base wall. The disk includes a plurality of axially extending spacer elements around the disk to engage the undersurface of the base wall and space the disk from the base wall of the shell, and angularly spaced fingers extending from the disk through the central opening of the base wall to retain the disk within the shell. A resilient liner is disposed on an underside of the disk for sealing engagement with the container finish.

15 Claims, 6 Drawing Sheets

PLASTIC CLOSURE, CLOSURE AND CONTAINER PACKAGE, AND METHOD OF MANUFACTURE

The present invention is directed to plastic closures for beverage, food, juice, pharmaceutical and like applications, and more particularly to a closure, a package and a method of manufacture that are particularly well suited for high-temperature (e.g., pasteurization, hot fill, asceptic fill and retort) applications.

BACKGROUND AND OBJECTS OF THE INVENTION

It has heretofore been proposed to provide a plastic closure for a container, which comprises a plastic cap or shell with an interior liner for sealing engagement with a sealing surface of the container finish. For example, U.S. Pat. No. 4,984,703 discloses a plastic closure that comprises a shell having a base wall with a peripheral skirt and an internal thread for securing the closure to a container finish, and a sealing liner compression molded in situ on the interior of the shell base wall. U.S. Pat. No. 5,451,360 discloses a method and apparatus for compression molding the liner in situ within the closure shell. It has also been proposed to provide plastic resin barrier materials within the sealing liner for resisting transmission of gases (e.g., carbon dioxide and oxygen), water vapor and/or flavorants through the liner. For example, U.S. Pat. No. 6,371,318 discloses a plastic closure and method of manufacture in which the liner is compression molded in situ on the interior surface of the closure base wall, and includes a multiplicity of alternating layers of matrix polymer such as EVA and barrier polymer such as EVOH. U.S. Pat. No. 6,399,170 discloses a plastic closure and method of manufacture in which the liner is compression molded in situ on the interior surface of the closure base wall, and includes a dispersion of barrier polymer platelets, such as EVOH, dispersed within matrix polymer such as EVA.

It is desirable to provide a closure and liner construction, a method of closure manufacture, and a closure and container package that are particularly well adapted for high-temperature applications. Such high-temperature applications include, for example, applications in which the container is filled with product while the product is hot, such as so-called hot fill and asceptic fill applications. High-temperature applications also include applications in which the filled package is subjected to pasteurization or retort after filling. During retort applications, for example, the filled package may be subjected to a temperature of 265° F. for fifteen minutes. High-temperature situations can also occur when a package is filled with a carbonated beverage and subjected to storage under high-temperature conditions, in which the internal pressure within the container can increase dramatically. In all of such high-temperature situations, the container closure is subjected to elevated internal pressure, which tends to distort or dome the closure base wall and lift the sealing liner away from sealing engagement with the container finish.

Copending U.S. application Ser. No. 09/994,554, filed Nov. 27, 2001 and assigned to the assignee of the present application, discloses a plastic closure that has particular utility for such high temperature and retort applications. The closure includes a shell having a base wall and a skirt with one or more internal threads for securing the closure to a container finish. In some embodiments, a plastic disk is loosely captured within the closure shell. An annular ring extends axially from the disk adjacent to but spaced from the periphery of the disk. A resilient liner is molded onto the disk over at least the central portion of the disk and over the ring on the disk. The ring urges the liner into sealing engagement with the radially inner edge and the axial end of the container finish when the closure is secured to the container finish. In some embodiments of the closure disclosed in the copending application, the disk includes an annular rib around the periphery of the disk, with the liner extending around the inner periphery of the rib. The disk thus urges the liner into sealing engagement with the inner and outer edges of the container finish as well as the axial end of the container finish. When a filled package that includes such a closure is subjected to elevated temperatures, during retort applications for example, the liner is maintained in sealing contact with the container finish.

Although the closure, package and method of manufacture disclosed in the noted copending application address and overcome problems theretofore extant in the art, further improvements remain desirable. In particular, in embodiments in which the liner is disposed on a separate disk retained within the closure shell, there are concerns associated with potential accumulation of debris and/or liquid product in the space between the disk and the base wall of the closure shell, which can promote growth of mold or other undesirable matter. It is therefore a general object of the present invention to provide a closure, a closure and container package, and a method of manufacture that include facility for flushing the area between the closure shell and the liner disk after the closure has been assembled to the container.

SUMMARY OF THE INVENTION

A plastic closure in accordance with a first aspect of the present invention includes a plastic closure shell having a base wall with a central opening and a skirt with at least one internal thread or bead for securing the closure to a container finish. A plastic disk is retained within the shell parallel to but spaced from the base wall. The disk includes a plurality of axially extending spacer elements around the disk to engage an underside of said base wall and space the disk from the base wall of the shell, and angularly spaced fingers that extend from the disk through the central opening of the base wall to retain the disk within the shell. A resilient liner is disposed on an underside of the disk for sealing engagement with the container finish.

A two-piece plastic closure in accordance with another aspect of the present invention includes a plastic closure shell having a base wall with a central opening and a skirt with at least one internal thread or bead for securing the closure to a container finish. A plastic disk is retained within the shell parallel to but separate from the base wall. The disk includes an axially extending bead composed of a plurality of angularly spaced bead segments around a peripheral portion of the disk to space the disk from the base wall of the shell. A plurality of angularly spaced fingers extend from the disk through the central opening of the base wall concentrically with the bead and retain the disk within the shell. A resilient sealing liner is molded in situ on an underside of the disk for sealing engagement with a container finish.

A closure and container package in accordance with a further aspect of the present invention includes a glass or plastic container having a finish with at least one external thread. A plastic closure includes a closure shell having a base wall with a central opening and a skirt with at least one internal thread engaged with the external thread on the container finish. A disk is disposed within the shell. The disk includes a plurality of angularly spaced axially extending spacer elements around the disk in abutting engagement with the base wall and spacing the disk from the base wall. Angularly spaced fingers extend through the opening in the base wall to retain the disk within the shell when the closure is removed from the container finish. A resilient liner is disposed on an underside of the disk in sealing engagement with the container finish around the periphery of the disk.

A method of making a closure and container package in accordance with yet another aspect of the present invention includes providing a glass or plastic container having a finish with at least one external thread, and a closure that includes a shell with a skirt having at least one internal thread. The closure shell has a base wall with a central opening, and a plastic disk is retained within the shell parallel to but separate from the base wall. The disk includes a plurality of angularly axially extending spacer elements, preferably in the form of an axially extending bead composed of a plurality of spaced bead segments around a peripheral portion of the disk, to space the disk from the base wall of the shell. A plurality of angularly spaced fingers extending from the disk through the central opening of the base wall and retain the disk within the shell. A resilient liner is disposed on an underside of the disk. The container is filled with a fluid product, and the closure is secured to the container with the liner in sealing engagement with the container finish. Fluid is then directed into the central opening of the base wall between the fingers, between the base wall and the disk, through the gaps between the spacer elements on the disk, and then between the closure skirt and the container finish to flush any debris or liquid product that may have entered this area during handling of the closure or filling of the container.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

The disclosure of above-noted U.S. application Ser. No. 09/994,554 is incorporated herein by reference.

Figure 1:
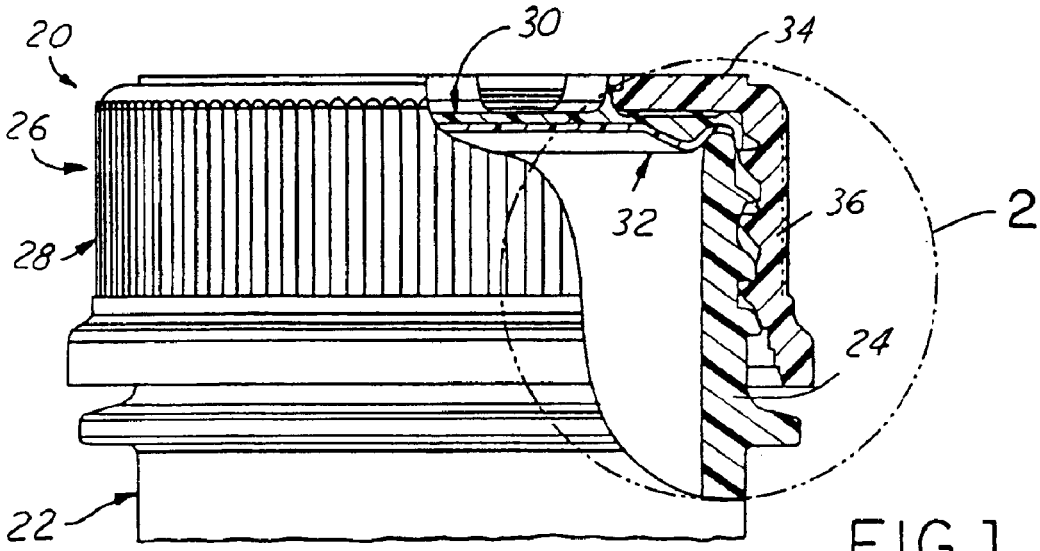
FIG. 1 is a partially sectioned fragmentary elevational view of a closure and container package in accordance with one exemplary preferred embodiment of the invention.
Figure 2:
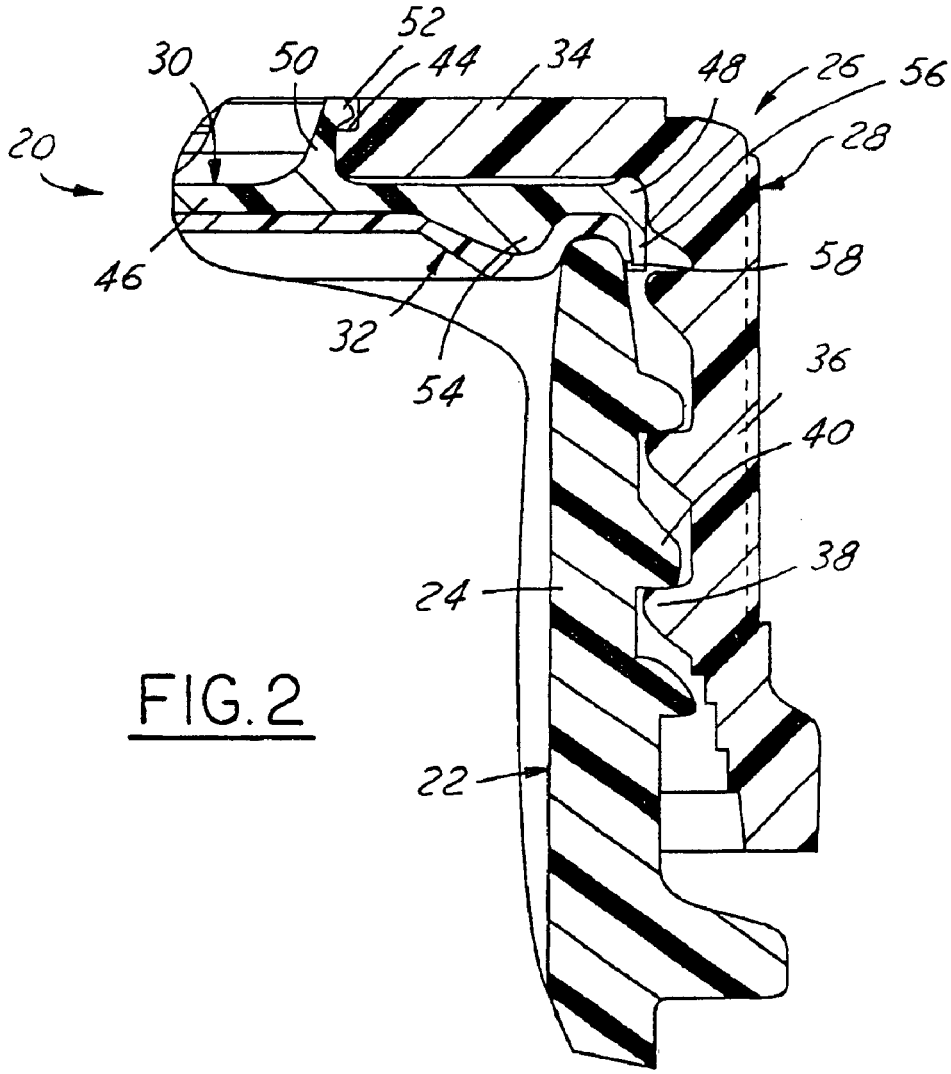
FIG. 2 is a fragmentary sectional view on an enlarged scale of the portion of FIG. 1 within the area 2.
Figure 3:
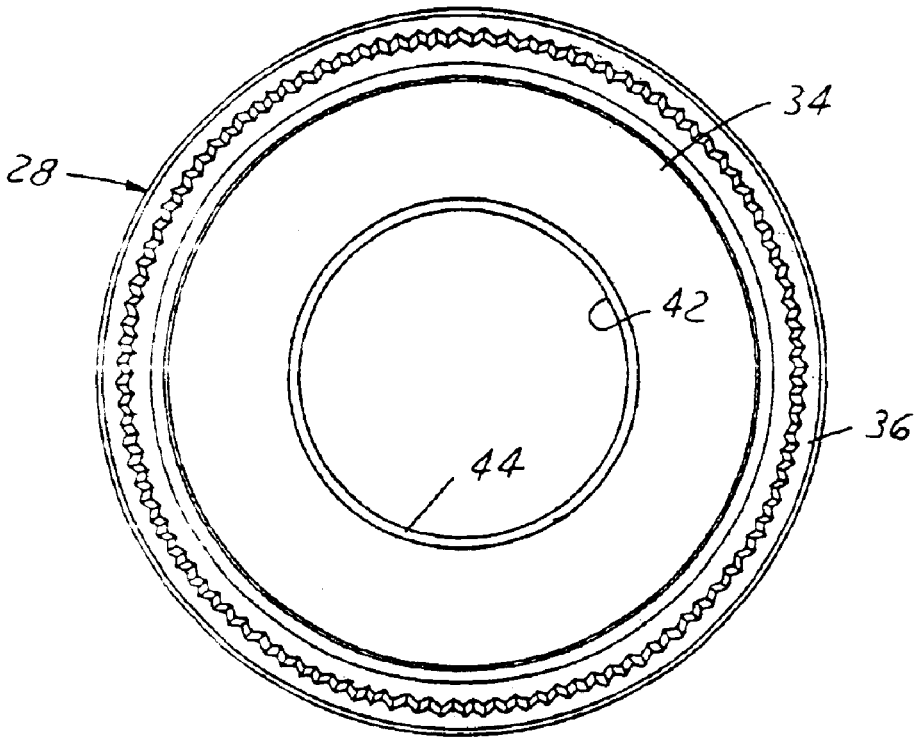
FIG. 3 is a top plan view of the closure shell in the package of FIGS. 1–2.

FIGS. 1–2 illustrate a closure and container package 20 in accordance with one presently preferred but exemplary embodiment of the invention as comprising a container 22 having a cylindrical finish 24. A closure 26 is externally secured to container finish 24. Closure 26 is an assembly that includes a closure shell 28, a liner disk 30 and a sealing liner 32. Closure shell 28 includes a base wall 34 and a peripheral skirt 36 having one or more internal threads 38 for engagement with one or more external threads 40 on container finish 24. Closure skirt 36 and container finish 24 alternatively may include one or more beads for securement of the closure to the container, although engaging threads are currently preferred. It is also contemplated that closure shell 28 may comprise a dual-wall shell that has an inner wall or skirt with internal threads 38 and an outer wall or skirt to coordinate with the sidewall of the container. Closure shell 28 also may include a tamper-indicating band connected by frangible bridges or a frangible web to the lower edge of the skirt. (Directional words such as "upper" and "lower" are employed by way of description and not limitation with respect to the upright orientation of the package illustrated in FIGS. 1 and 2. Directional words such as "axial" and "radial" are employed by way of description and not limitation with respect to the axis of the container finish or the closure skirt, as applicable.) Closure base wall 34 has a central through-opening 42 (FIGS. 1–3) that is coaxial with skirt 36. Opening 42 is surrounded by an axially outwardly or upwardly facing ledge 44 that is recessed from the upper surface of base wall 34.

Figure 4:
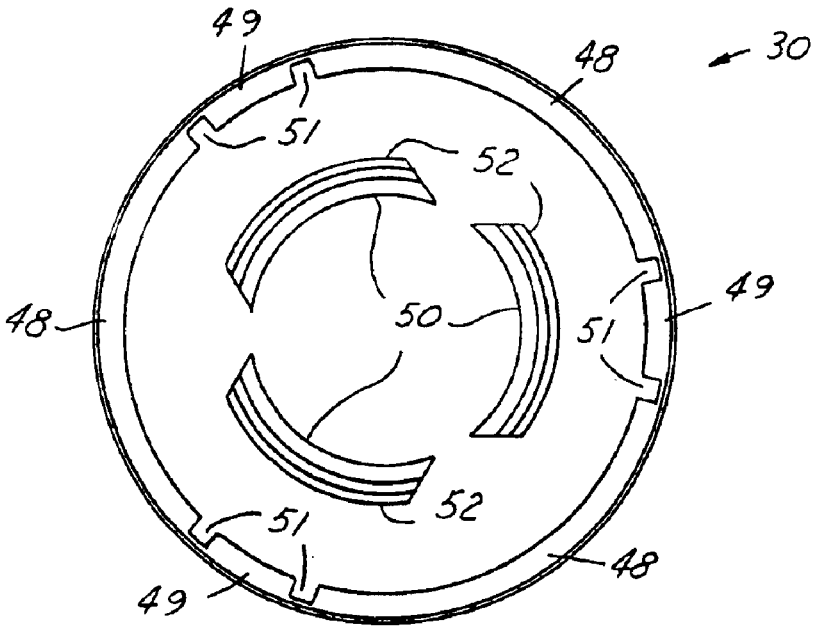
FIG. 4 is a top plan view of the liner disk in the package of FIGS. 1–2.

Disk 30 is disposed within closure shell 28. Disk 30 includes a generally flat disk body 46 having a circular periphery with an axially upwardly extending peripheral bead, which is formed in this embodiment by a plurality of angularly spaced circumferentially aligned bead segments 48, 49, as best seen in FIG. 4. Bead segments 48, 49 are disposed axially to engage the undersurface of closure base wall 34 to space disk body 46 from the base wall. A plurality of angularly spaced flexible resilient spring fingers 50 extend upwardly from the upper surface of disk body 46. As best seen in FIG. 4, each finger 50 is radially aligned with an associated bead segment 49, which in turn is spaced from the opposed ends of adjacent bead segments 48 by a pair of gaps 51. Bead segments 49 preferably are of shorter circumferential dimension than are fingers 50, so that each finger 50 is also radially aligned with an associated pair of gaps 51. Each spring finger 50 extends upwardly from the upper surface of disk body 46, and then radially outwardly in the form of a rounded bead 52. In assembly, beads 52 of fingers 50 are received by snap fit over shoulder 44 on shell base wall 34 to retain the disk in assembly with the shell. This retention of the disk preferably is a loose retention (before assembly to a container), allowing disk 30 to rotate with respect to the surrounding shell. The ends of the fingers and the beads preferably are flush with or beneath the upper surface of base wall 34 when the closure is secured to the container finish, as best seen in FIGS. 1 and 2.

Figure 11:
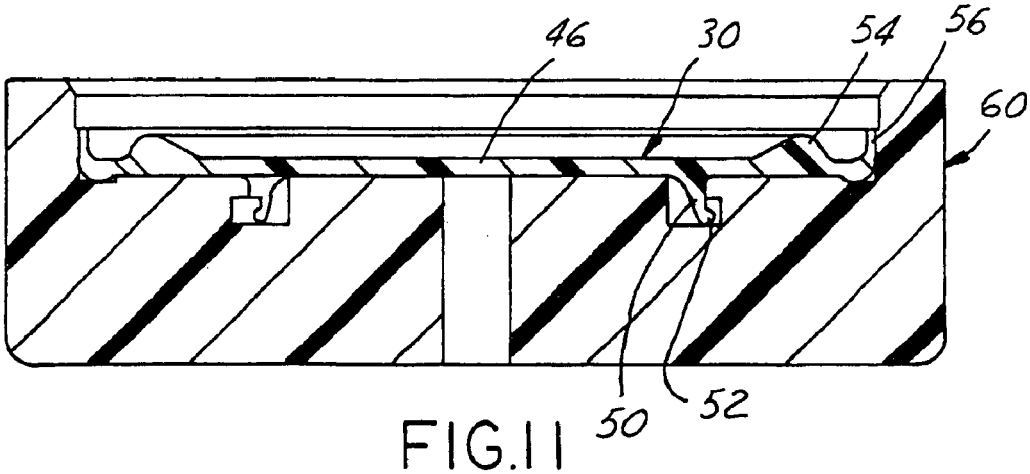
FIG. 11 is a sectional view that diametrically bisects a fixture for molding a liner on a closure disk in accordance with an exemplary embodiment of the invention.

Sealing liner 32 preferably is flexible and resilient, and is disposed on the underside or undersurface of disk body 46. Liner 32 preferably is compression molded in situ onto disk 30 while disk 30 is captured within the closure shell. That is, disk 30 is first placed within the closure shell and captured by snap fit of fingers 50 over base wall shoulder 44, and liner 32 is then compression molded in situ onto the disk. Alternatively, but less preferably, the liner may be compression molded onto the disk employing an assembly fixture 60 such as that illustrated in FIG. 11, and the disk/liner subassembly then assembled to the closure shell. As another alternative, the liner may be formed separately, such as by stamping from a sheet of liner material, and then secured to the undersurface of the disk by adhesive or other suitable means. Liner 32 may be of any suitable material construction. In accordance with the preferred embodiments of the invention, liner 32 is of resin construction, and most preferably includes a barrier material to resist permeation of gases, water vapor and/or flavorants through the liner. The liner most preferably is provided in accordance with the disclosure of one of the U.S. Pat. Nos. 6,371,318 and 6,399,170 noted above, the disclosures of which are incorporated herein by reference. Other suitable barrier liners or non-barrier liners alternatively may be employed. Closure shell 28 and disk 30 preferably are of molded plastic construction, such as polypropylene. Container 22 may be of glass or plastic construction.

Figure 6:
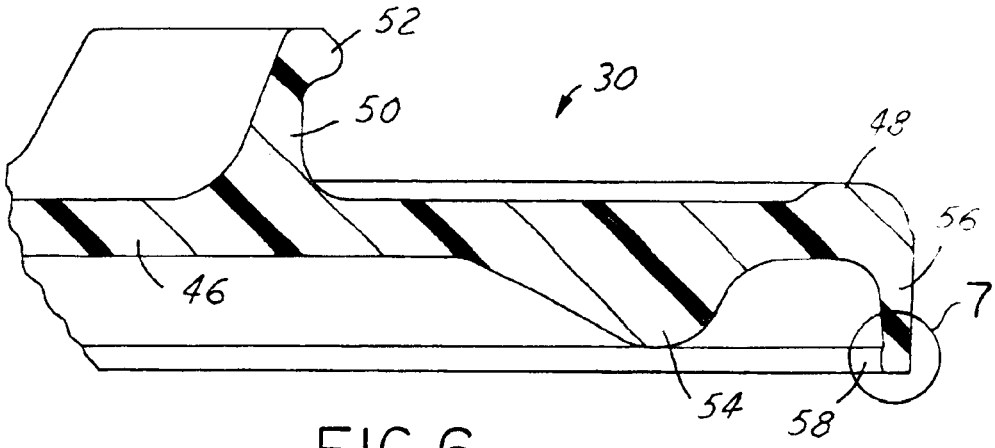
FIG. 6 is a fragmentary sectional view on an enlarged scale of the portion of FIG. 5 within the area 6.
Figure 7:
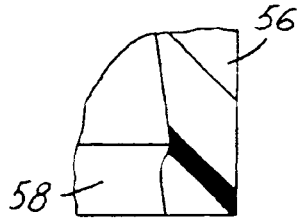
FIG. 7 is a fragmentary sectional view on an enlarged scale of the portion of FIG. 6 within the area 7.

After container 22 has been filled with material, typically fluid material, closure 26 is secured over the finish of the container. Rotation of closure shell 28 to engage threads 38, 40 pushes disk 30 and liner 32 over the axial end of the container finish. If disk 30 is loosely retained within the shell, as is preferred, disk 30 and liner 32 do not rotate with respect to the container finish after engagement with the finish, but merely are axially pressed onto the container finish as shell 28 is threaded onto the finish. Liner 32 is pressed into sealing engagement against the axial end of the container finish, against the radially inside edge of the container finish by a bead 54 on disk body 46, and against the radially outer edge of the container finish by a ring 56 that extends around the outer periphery of disk body 46. Ring 56 has a wiper bead 58 (FIGS. 6 and 7) that slidably engages the outside edge container finish to align disk 30 and liner 32 with the edge of the container finish. Disposition of disk bead 48 around the periphery of the disk places the bead in approximate axial alignment with the end of the container finish, so that compression of the liner and the disk as the closure is secured to the container does not tend to bend or distort the body of the disk. After the closure is secured to the container, flushing fluid, such as air or water, may be directed into opening 42 of closure base wall 34 and between disk fingers 50 into the area between the upper surface of disk body 46 and the lower surface of closure base wall 34. This flushing fluid travels radially outwardly through this area between the disk and the closure base wall, through gaps 51 between disk peripheral bead segments 48, 49, and then downwardly between the inside surface of skirt 36 and the outside surface of finish 24. Disposition of fingers 50 in alignment with gaps 51 between bead segments 48, 49 (FIG. 4) ensures that the flushing fluid traverses the entire area between the disk and the closure base wall.

Figure 5:
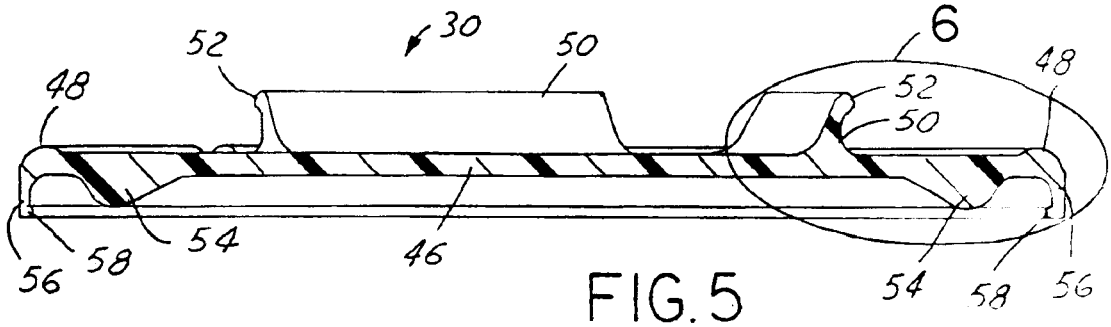
FIG. 5 is a sectional view taken substantially along the line 5—5 in FIG. 4.
Figure 8:
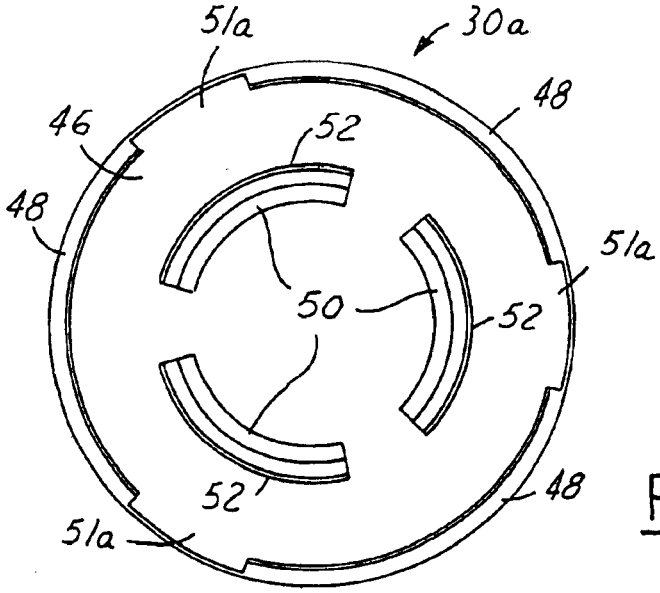
FIG. 8 is a top plan view of a closure disk, similar to that of FIG. 4 but illustrating an exemplary modified embodiment of the invention.
Figure 9:
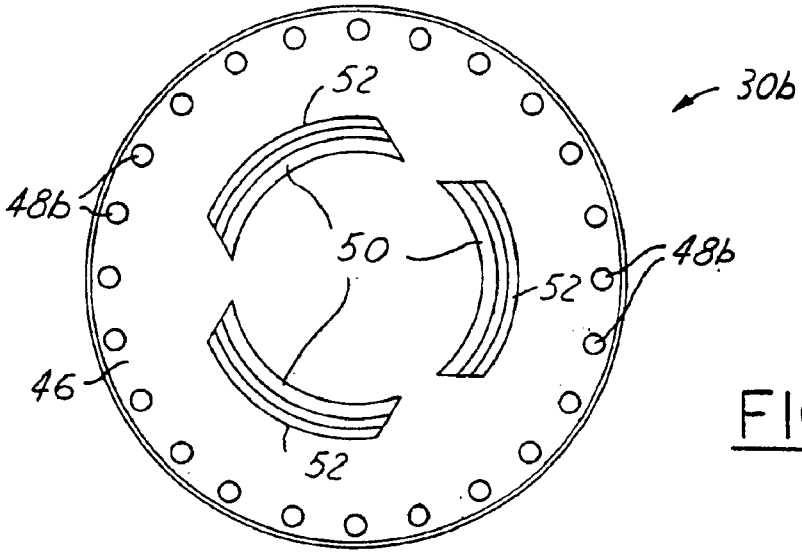
FIG. 9 is a top plan view of a closure disk in accordance with another exemplary embodiment of the invention.
Figure 10:
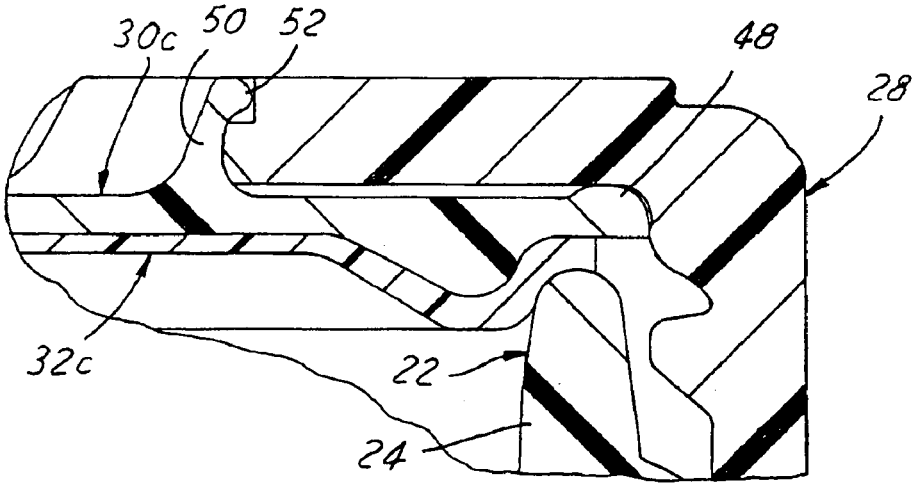
FIG. 10 is a fragmentary sectional view that is similar to a portion of FIG. 2 but illustrates another exemplary embodiment of the invention.
Figure 12:
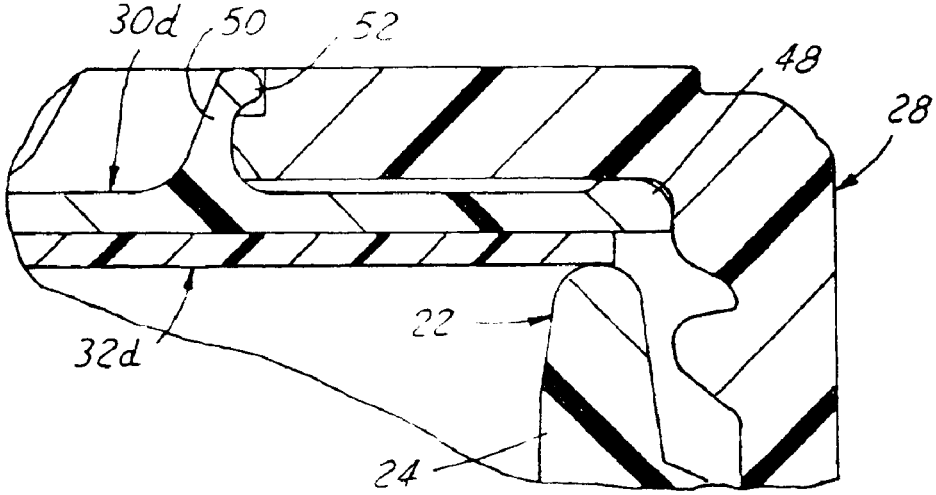
FIG. 12 is a fragmentary sectional view that illustrates a modification to the embodiment of FIG. 10.

FIG. 8 illustrates a modified liner disk 30*a* in which, as compared with disk 30 in FIG. 4, bead segments 49 are eliminated, and gaps 51*a* between opposed ends of bead segments 48 are correspondingly enlarged. Liner disk 30 of FIG. 4 is preferred because bead segments 49 provide support between the disk periphery and the underside of the closure shell base wall against forces applied to the disk by tightening of the closure onto a container finish. FIG. 9 illustrates another modified liner disk 30*b*, in which bead segments 48, 49 of FIG. 4, or bead segments 48 of FIG. 8, are replaced by a circumferential array of angularly spaced nubs or lugs 48*b*. This circumferential array of nubs is disposed adjacent to the periphery of disk body 46 to provide support against the forces incurred as the closure is applied to the container finish. FIG. 10 illustrates a modified closure assembly in which liner disk 30*c* terminates at bead segments 48—i.e., does not include ring 46 and wiper bead 48 of the embodiment in FIGS. 2 and 5–6. Liner 32*c* terminates at the periphery of disk 30*c*, and does not extend around the radially outer edge of the container finish. FIG. 12 illustrates a modification to the embodiment of FIG. 10 in which disk 30*d* and liner 32*d* are flat in the sealing area—i.e., the disk bead 54 (FIG. 2) has been deleted.

Figure 13:
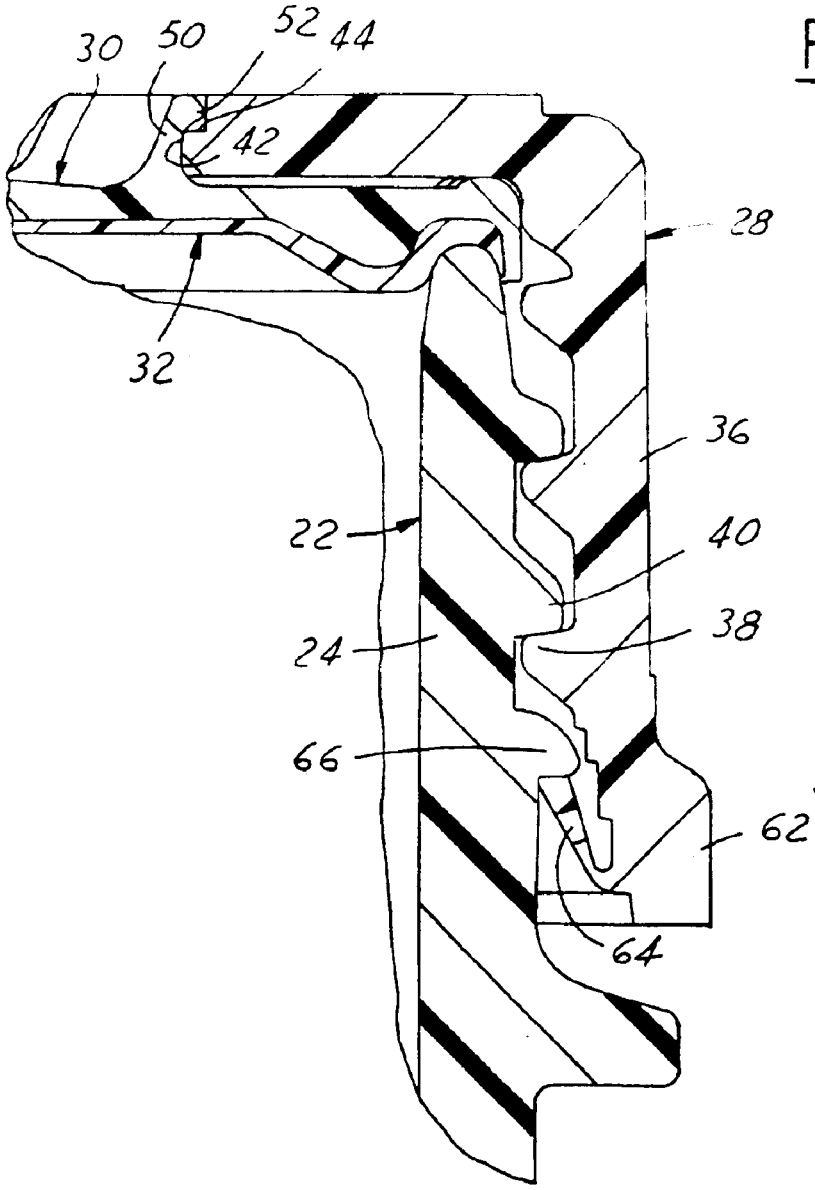
FIG. 13 is a fragmentary sectional view that illustrates a modification to the embodiment of FIG. 2.

FIG. 13 illustrates a modification to the embodiment of FIG. 2, in which a tamper indicating band 62 is frangibly secured to the lower edge of closure skirt 36. A circumferentially continuous or segmented stop flange 64 extends from band 62 to engage a stop bead 66 on container finish 24. In an embodiment of the invention having a tamper indicating band (FIGS. 13 and 14), the dimensional relationships preferably are such that, when the closure is unthreaded from the container, the tamper indicating band is severed from the closure skirt before the seal is broken at the upper end of the container finish.

Figure 14:
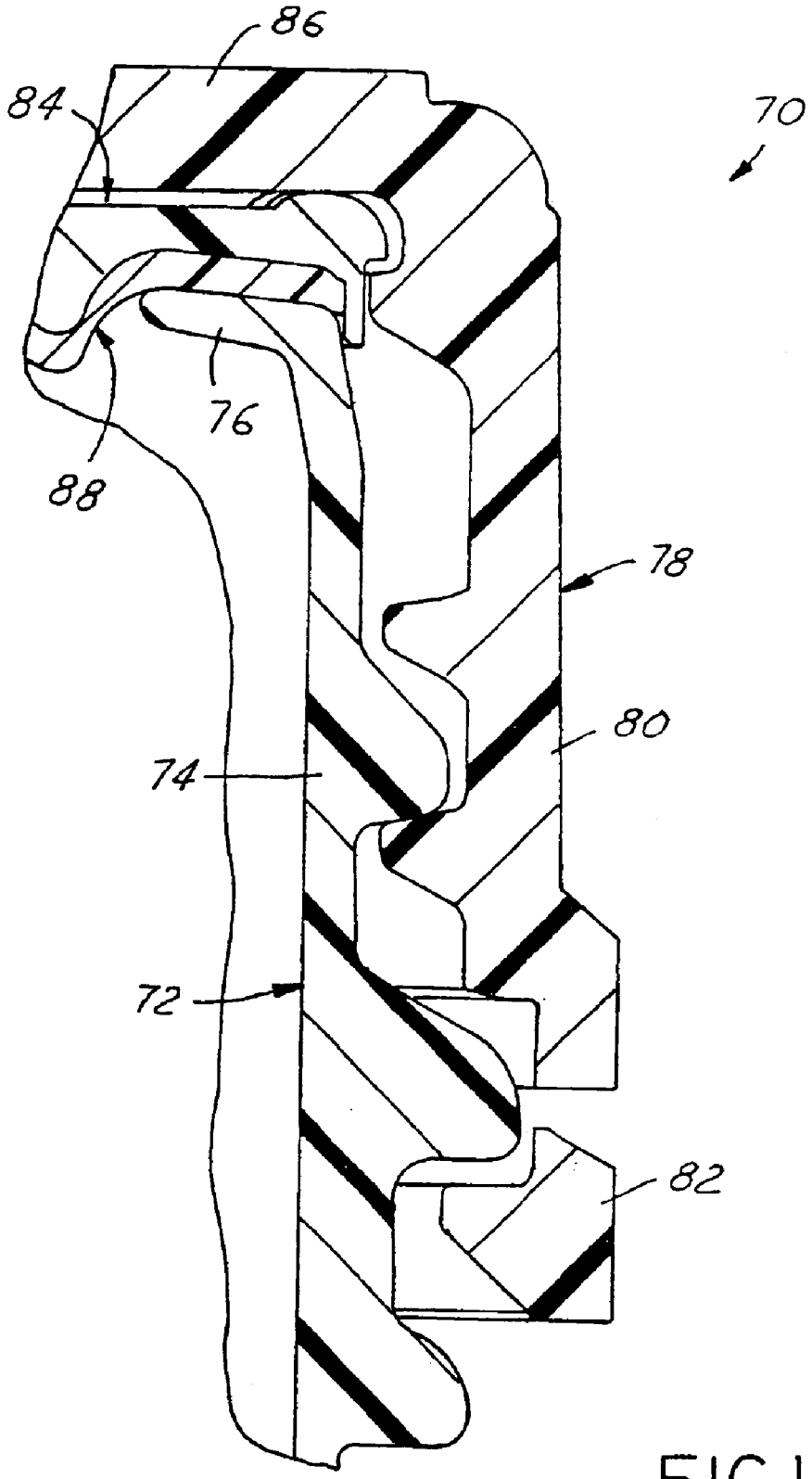
FIG. 14 is a fragmentary sectional view that illustrates a further embodiment of the invention.

FIG. 14 illustrates a closure and container package 70 in accordance with another embodiment of the invention. A molded plastic container 72 has a finish 74 that terminates in a flange 76, which is a vestige of a trimming operation after molding. A closure 78 has a skirt 80 with a tamper indicating band 82 connected thereto by frangible bridges. A disk 84 is secured to the base wall 86 of closure 78 as previously described, and a liner 88 is mounted on the underside of disk 84. Liner 88 engages finish flange 76 to seal the package. As previously noted in connection with FIG. 13, the dimensional relationships of the closure and container, and the flexibility of flange 76, preferably are such that tamper indicating band 82 is ruptured from skirt 80 before the seal is broken at liner 88.

Container 22 (FIGS. 1–2, 10 and 12–13) may be of glass or plastic construction. Container 72 (FIG. 14) preferably is of blow molded plastic construction. Closure shells 28 and 78, disks 30, 30*a*, 30*b*, 30*c*, 30*d*, and 84 may be of any suitable plastic construction, such as polypropylene.

There have thus been disclosed a plastic closure, a closure and container package, and a method of manufacture that fully satisfy all of the objects and aims previously set forth. The closure and package possess superior sealing capabilities, particularly in high-temperature applications such as hot-fill, asceptic-fill, pasteurization and retort applications. The closure and package are also adapted to be flushed with fluid after filling and application of the closure to remove debris and any excess liquid that may have resulted from the filling operation. The invention has been described in conjunction with a number of aspects and embodiments, and a number of modifications and variations have been discussed. Other modifications and variations will readily suggest themselves to persons of ordinary skill in the art. Disk 30 preferably is loosely retained within the closure so that the disk and sealing liner will remain stationary with respect to the container finish while the closure shell is turned onto and off of the finish. This helps prevent damage to the liner. However, disk 30 could be non-movably secured to the closure shell in accordance with the broadest aspects of the invention as long as a path is provided for flushing fluid between the disk and the shell. The invention is intended to embrace these and all other modifications and variations as fall within the spirit and broad scope of the appended claims.

What is claimed is:

1. A plastic closure that comprises:

a plastic closure shell including a base wall with a central opening and a skirt with internal means for securing the closure to a container finish, a plastic disk retained within said shell parallel to but separate from said base wall, said disk including a plurality of axially extending spacer elements around said disk to engage an underside of said base wall and space said disk from said base wall of said shell, and angularly spaced fingers extending from said disk through said central opening of said base wall retaining said disk with said shell, and a resilient sealing liner on an underside of said disk for sealing engagement with a container finish.

2. The closure set forth in claim 1 wherein said spacer elements comprise a plurality of angularly spaced circumferentially aligned bead segments around a peripheral portion of said disk.

3. The closure set forth in claim 2 wherein each of said fingers is spaced radially inwardly from a gap between adjacent bead segments.

4. The closure set forth in claim 3 wherein there are angularly spaced gaps between bead segments, said gaps being in radial alignment with said fingers.

5. The closure set forth in claim 1 wherein said spacer elements comprise a plurality of angularly spaced lugs.

6. The closure set forth in claim 5 wherein said lugs are disposed in a circumferentially aligned array around a periphery of said disk.

7. The closure set forth in claim 1 wherein said disk is free to rotate with respect to said shell.

8. The closure set forth in claim 1 wherein said base wall of said closure shell has an axially outwardly facing recessed shoulder around said central opening, and wherein each of said fingers has a radially outwardly extending bead received by snap fit over said shoulder.

9. The closure set forth in claim 1 wherein said liner is molded in situ on said disk.

10. The closure set forth in claim 9 wherein said disk has an axially extending circumferentially continuous ring around a periphery of said disk, and said liner is molded onto a radially inwardly facing surface of said ring.

11. A two-piece plastic closure that comprises:

a plastic closure shell including a base wall with a central opening and a skirt with internal means for securing the closure to a container finish, and a plastic disk loosely retained within said shell parallel to but separate from said base wall, said disk including an axially extending bead composed of a plurality of angularly spaced bead segments around a peripheral portion of said disk to space said disk from said base wall of said shell, a plurality of angularly spaced fingers extending from said disk through said central opening of said base wall concentrically with said bead and loosely retaining said disk within said shell, and a resilient sealing liner on an underside of said disk for sealing engagement with a container finish.

12. The closure set forth in claim 11 wherein each of said fingers is spaced radially inwardly from a gap between adjacent segments of said bead.

13. The closure set forth in claim 12 wherein there are angularly spaced gaps between bead segments, said gaps being in radial alignment with said fingers.

14. The closure set forth in claim 11 wherein said base wall of said closure shell has an axially outwardly facing recessed shoulder around said central opening, and wherein each of said fingers has a radially outwardly extending bead received by snap fit over said shoulder.

15. The closure set forth in claim 11 wherein said disk has an axially extending circumferentially continuous ring around a periphery of said disk, and said liner is molded onto a radially inwardly facing surface of said ring.

* * * * *